US006698070B2

(12) United States Patent
Chen

(10) Patent No.: US 6,698,070 B2
(45) Date of Patent: Mar. 2, 2004

(54) STRUCTURE OF A MAGNETIC BELT BUCKLE

(76) Inventor: Hsi-Hsin Chen, PO Box 82-144, Taipei (TW)

( * ) Notice: Subject to any disclaimer, the term of this patent is extended or adjusted under 35 U.S.C. 154(b) by 79 days.

(21) Appl. No.: 09/998,158

(22) Filed: Dec. 3, 2001

(65) Prior Publication Data

US 2003/0101547 A1 Jun. 5, 2003

(51) Int. Cl.[7] ..... A44B 11/20; A44B 11/06

(52) U.S. Cl. ..... 24/303; 24/185; 24/188

(58) Field of Search ..... 24/303, 163 R, 24/171, 181, 185–189, 194, 195, 265 BC, 308, 309; 224/163, 183, 918; 2/312, 321, 322; 292/251.5; 335/285

(56) References Cited

U.S. PATENT DOCUMENTS 2,867,023 A * 1/1959 Putman ..... 24/163 R
3,799,610 A * 3/1974 Hollins ..... 297/468
4,384,390 A * 5/1983 Hayakawa ..... 224/163
4,527,311 A * 7/1985 Aoki ..... 24/303
4,529,111 A * 7/1985 Hayakawa ..... 224/163
4,566,158 A * 1/1986 Lau ..... 24/578.15
5,323,516 A * 6/1994 Hartmann ..... 24/303
5,377,392 A * 1/1995 Morita ..... 24/303
5,701,640 A * 12/1997 Locher ..... 24/303
6,067,692 A * 5/2000 Chang ..... 24/303
6,142,348 A * 11/2000 Park ..... 224/163

* cited by examiner

*Primary Examiner*—Anthony Knight
*Assistant Examiner*—Ruth C. Rodriguez
(74) *Attorney, Agent, or Firm*—Leong C. Lei

(57) ABSTRACT

A structure of a magnetic belt buckle is disclosed. The magnetic belt buckle comprises a top cover, magnets, a pulling ring, an iron block and a bottom housing and at least one moving-type magnet, characterized in that the top cover, the bottom housing and one end of the belt are mounted with magnets of same poles to facilitate and rapid adjustment of belt by means of repelling force between the magnets so as to attain the optimum fastening, and by means of the moving-type magnets to mutually repel with each other, and to attract with the iron block, the tightening of belt is maintained.

3 Claims, 7 Drawing Sheets

STRUCTURE OF A MAGNETIC BELT BUCKLE

BACKGROUND OF THE INVENTION (a) Technical Field of the Invention

The present invention relates to buckle of a belt, and in particular, to a magnetic belt buckle which facilitates adjustment of tightness of belt after buckling to the waist of the wearer.

(b) Description of the Prior Art

Conventional belt is provided with a belt head (buckle) at one end of the belt, which is fastened to the other end of the belt. The end portion of the belt is provided with a plurality of holes, which is fastened to the buckle so as to provide a fastening to the waist of the wearer. To adjust the tightness of the belt, different holes have to be used for fastening to the buckle. However, adjustment of tightness from one hole to another hole does not provide a slight adjustment. Therefore, it is an object of the present invention to provide a structure of a magnetic belt buckle, which mitigates the above-drawback by allowing a slight adjustment of the belt buckle.

SUMMARY OF THE INVENTION

Accordingly, it is an object of the present invention to provide a structure of a magnetic belt buckle comprising a top cover, magnets, a pulling ring, an iron block and a bottom housing and at least one moving-type magnet, characterized in that the top cover, the bottom housing and one end of the belt are mounted with magnets of same poles to facilitate and rapid adjustment of belt by means of repelling force between the magnets so as to attain the optimum fastening, and by means of the moving-type magnets to mutually repel with each other, and to attract with the iron block, the tightening of belt is maintained.

Yet another object of the present invention is to provide a structure of a magnetic belt buckle wherein the belt is of an appropriate length and is mounted with at least one moving-type magnet, thereby repelling force is increased between magnets of same poles.

A further object of the present invention is to provide a structure of a magnetic belt buckle, wherein the loosening and tightening of the belt can be slightly adjusted to provide the most appropriate tightness of belting to the waist of the user.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example. dr

DETAILED DESCRIPTION OF THE PREFERRED EMBODIMENT

Figure 1:
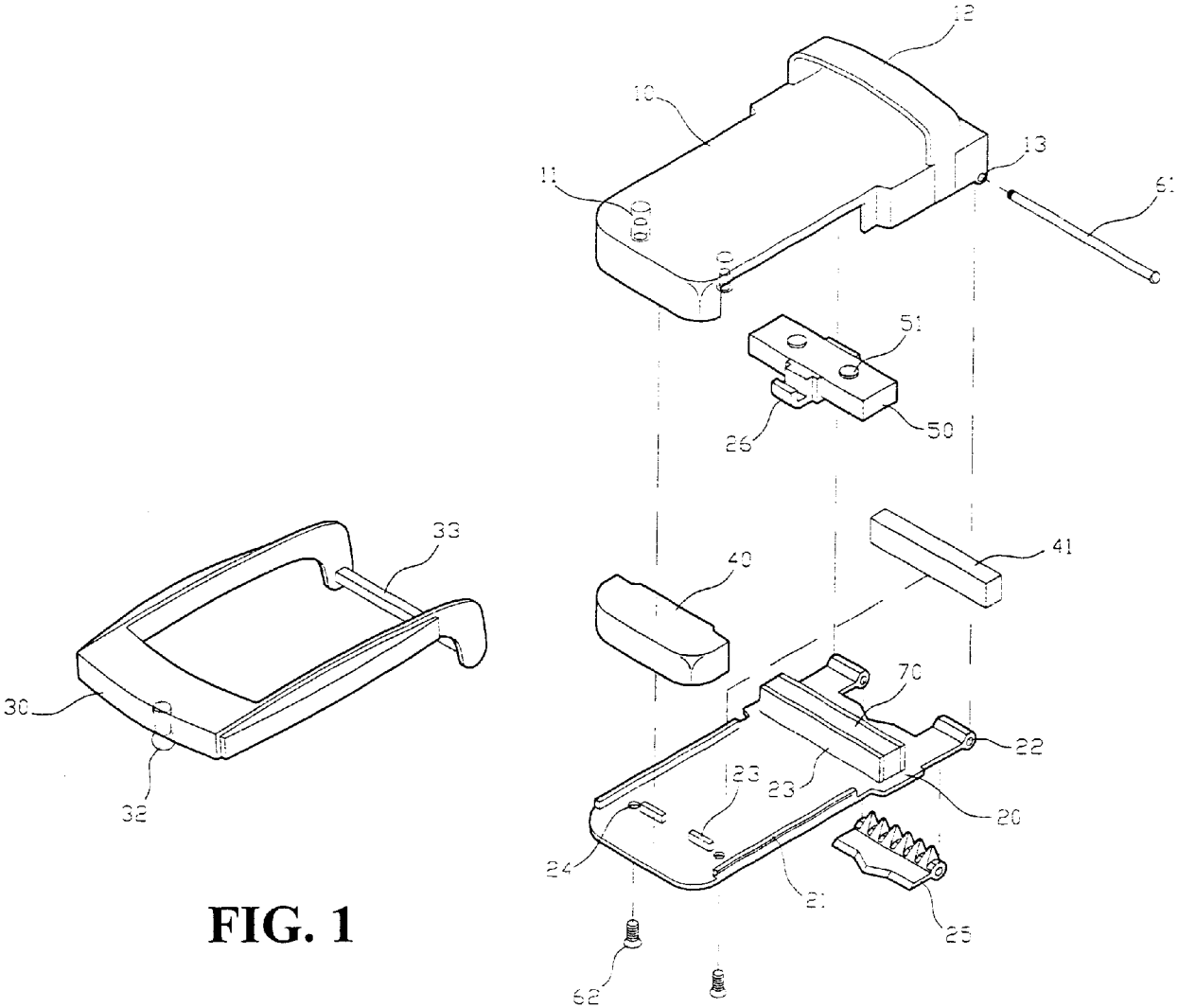
FIG. 1 is an exploded perspective view of an externally-mounted type magnetic belt buckle of the present invention.
Figure 2:
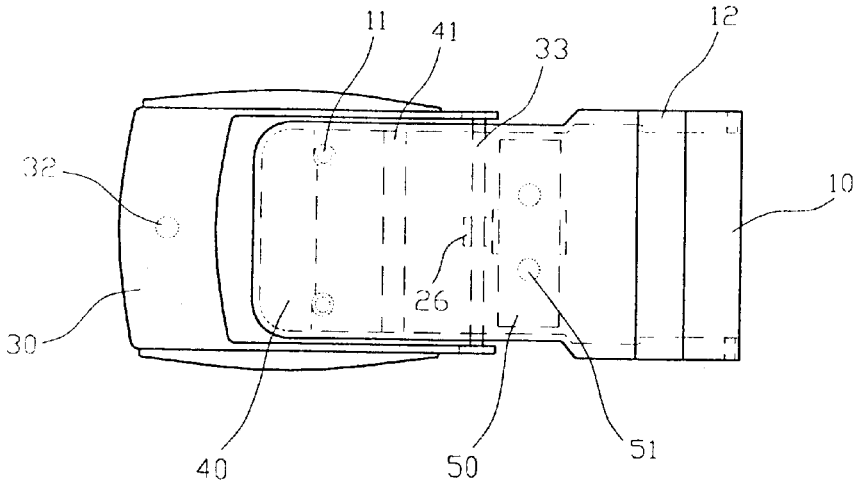
FIG. 2 schematically shows the top cover of a magnetic belt buckle of the present invention.
Figure 3:
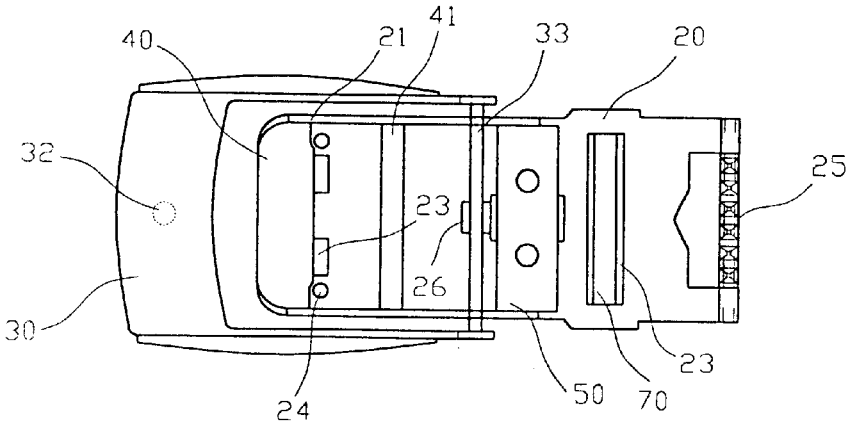
FIG. 3 schematically shows the bottom housing of a magnetic belt buckle of the present invention.

The following descriptions are of exemplary embodiments only, and are intended to limit the scope, applicability or configuration of the invention any way. Rather, the following description provides a convenient illustration for implementing exemplary embodiments of the invention. Various changes to the described embodiments may be made in the function and arrangement of the elements described without departing from the scope of the invention as set forth in the appended claims. Referring to FIGS. 1 to 3, there is shown a structure of an externally-mounted magnetic belt buckle. As shown in the figure, the belt buckle comprises a top cover 10, a bottom housing 20, and a pulling ring 30, and magnets 40,50. The top cover 10 is substantially an "arch" shaped body. Two sides of the cover l are provided respectively with a recess for the mounting of magnet 50 which is mounted to the cover 10 by a recessed fastening seat 26. The surface of the magnet 50 and the bottom section of the fastening seat 26 are provided with two top blocks 51 and the center of the top cover is provided with a through hole. By means of a rear rod protrusion 33 of the pulling ring 30, the magnet 50 is located at the slot of the fastening seat 26 so that the magnet 50 slides within the top cover 10 and the bottom housing 20. The rear of the top cover 10 is mounted to a fastening ring 12, and a circular hole 13 is located at the sides, at the rear end of the top cover 10. The front side of the top cover 10 is provided with two screwed protrusions 11 for mounting together with the screw nuts 62 at the bottom housing 20. The screwed protrusions 11 are used to urge against another magnet 40, and one or more than one moving type magnet 41 is provided within the front side of the magnet 40 and the magnet fastened to the pulling ring 30. The additional magnet 40 provides appropriate repelling force so that the front end of the belt can be adjusted slightly. As a result of the arrangement of the iron block 70, the original tightness of the belt can be restored.

The bottom housing 20 is mounted to the top cover 10 at the upper edge thereof. The two sides of the bottom housing 20 are provided with two blocking plates 21 adaptable to the recess of the top cover 10 so that the magnet 50 can slide therein. There are through holes 22 at the rear side of the bottom housing 20 and the center thereof is provided with a stopping block 25 for urging at and positioning the end of the belt. A stop 23 is positioned at the recess of the stopping block 25 for mounting with the iron block 70. The screwed protrusions 11 for mounting with the top cover 10 are provided to the stop 23 so that the magnet 40 can be mounted at the cover 10 leaving only one contact face to provide a stable and strong magnetic surface.

Figure 4:
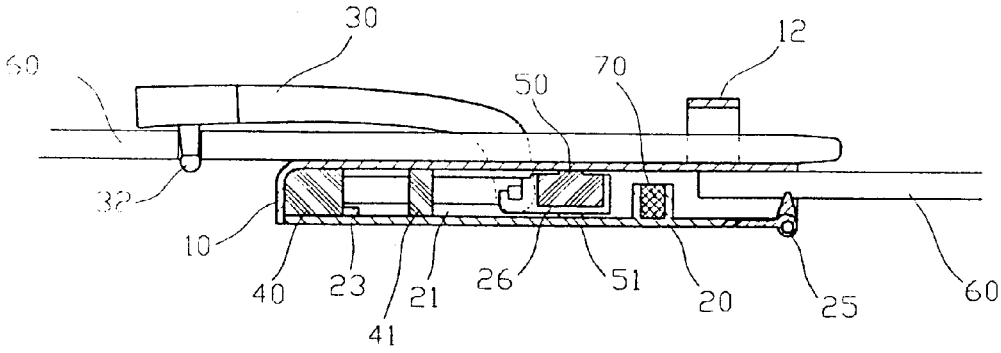
FIGS. 4 and 5 schematically show the operation of the magnetic belt buckle of the present invention.
Figure 5:
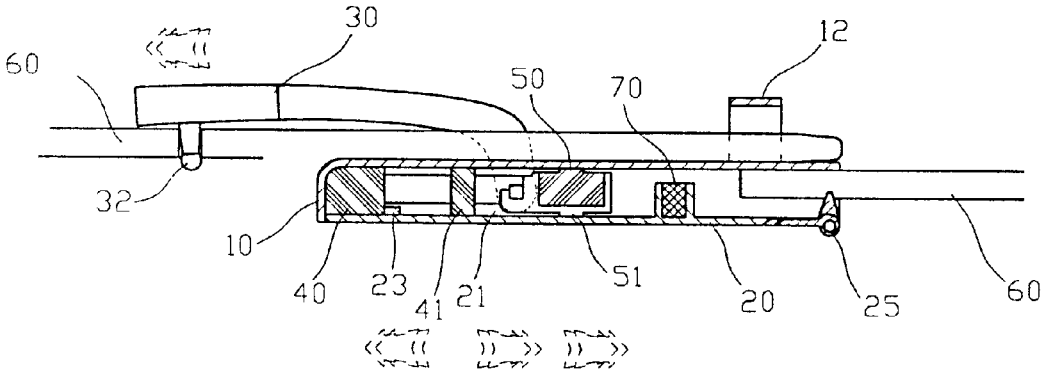

Referring to FIGS. 4 and 5, the magnets 40 and 50 are of similar poles and will repel with each other. The top cover 10 and the bottom housing 20 are fastened to each other, and a top needle 32 is mounted to the through hole of the belt 60. If a slight adjustment of tightness of the belt 60 is required, the two magnets 40, 50 (being having the same poles) will repel with each other and the iron block 70 at the front edge of the stopping block 25 will restore the belt 60 to the appropriate tightness.

Figure 6:
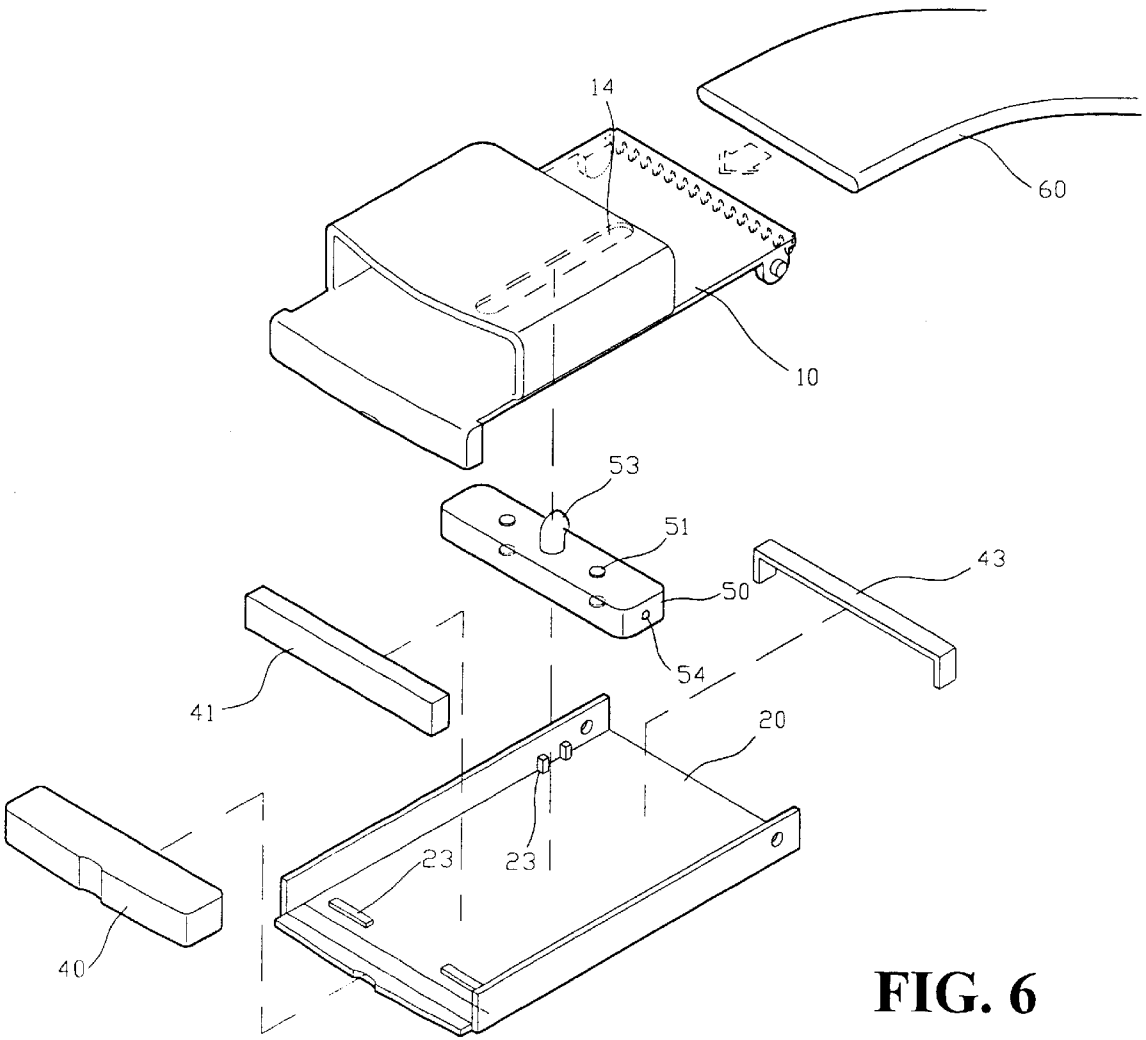
FIG. 6 is another preferred embodiment of the magnetic belt buckle of the present invention.

As shown in FIG. 6, the top cover 10 is provided with a guiding slot 14 and the interior of the cover 10 of the rear magnet 50 has a protrusion 53, and the top and bottom side of the top cover 10 are provided with a top block 51 mounted with steel beads or rail slot 54 so that the magnet 40 slides within the cover 10.

There are steps at the front and rear end of the bottom housing 20 for the adaptation of magnet, and the rear end has an arch-shaped iron block 43 to provide a repel force so that the belt 60 can restores to its tightness, As a result of the moving-type magnet 41, the repelling force increases so that the pulling out of the belt 60 is easy and is stable. One or more than one moving-type magnets 41 can be incorporated to the belt buckle.

Figure 7:
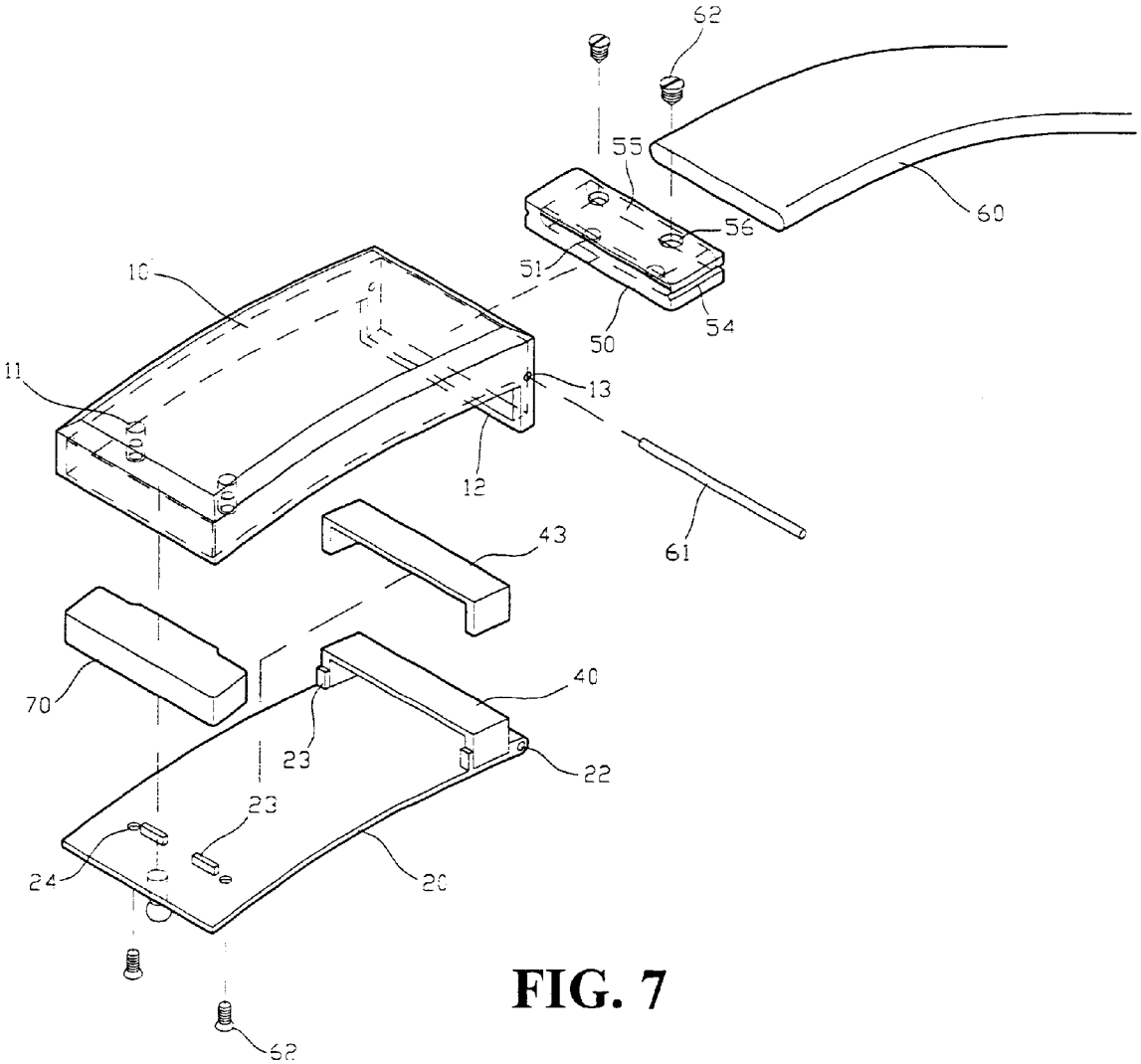
FIG. 7 is a preferred embodiment of an internal mounting buckle in accordance with the present invention.
Figure 8:
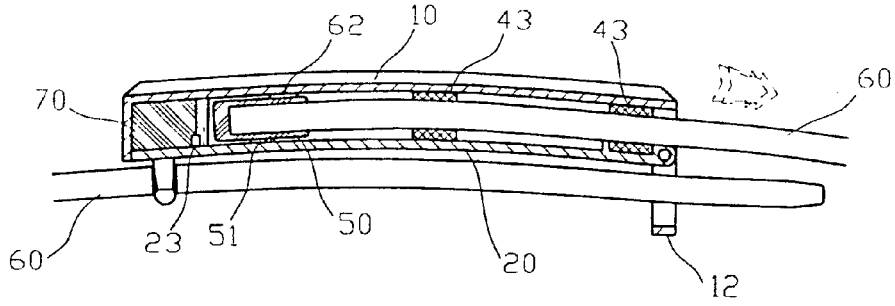
FIGS. 8 and 9 schematically show the operation of an internal-mounting buckle in accordance with the present invention.
Figure 9:
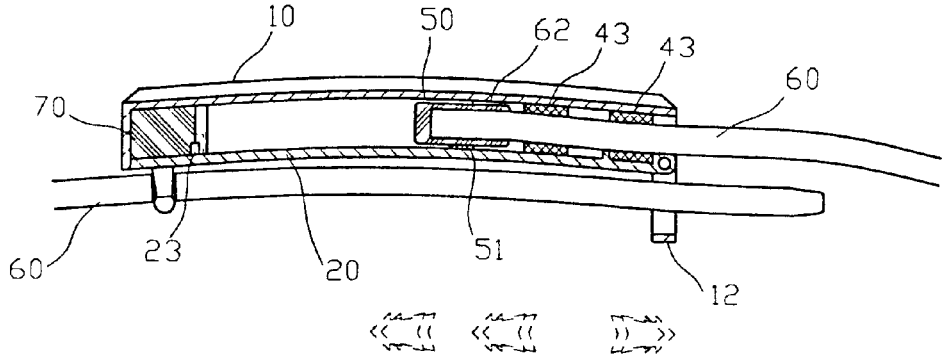

Referring to FIGS. 7 to 9, there is shown an internally-fastened type belt buckle in accordance with the present invention. On the top cover 10, two screwed protrusions 11 are provided to the front end of the cover 10, and the rear end of the top cover 10 is a fastening ring 12. There are circular holes 13 at the two sides of the top cover 10 for the passage of the rod protrusion 61 of the bottom housing 20 so as to connect with the bottom housing 20. The bottom housing 20 is also provided with two through holes 22, and a stop 23 is located in between the two holes 22.

The rear end of the bottom housing 20 is also provided with a stop 23 for the mounting of an arch-shaped iron block 43 to increase repelling force of the magnet. The top cover 10 and the bottom housing 20 enclose an iron block 70. The sides of the bottom housing 20 are provided with steel beads or rail slot 54, allowing point contact with other magnets and facilitating slide operation between the top cover 10 and the bottom housing 20.

Figure 10:
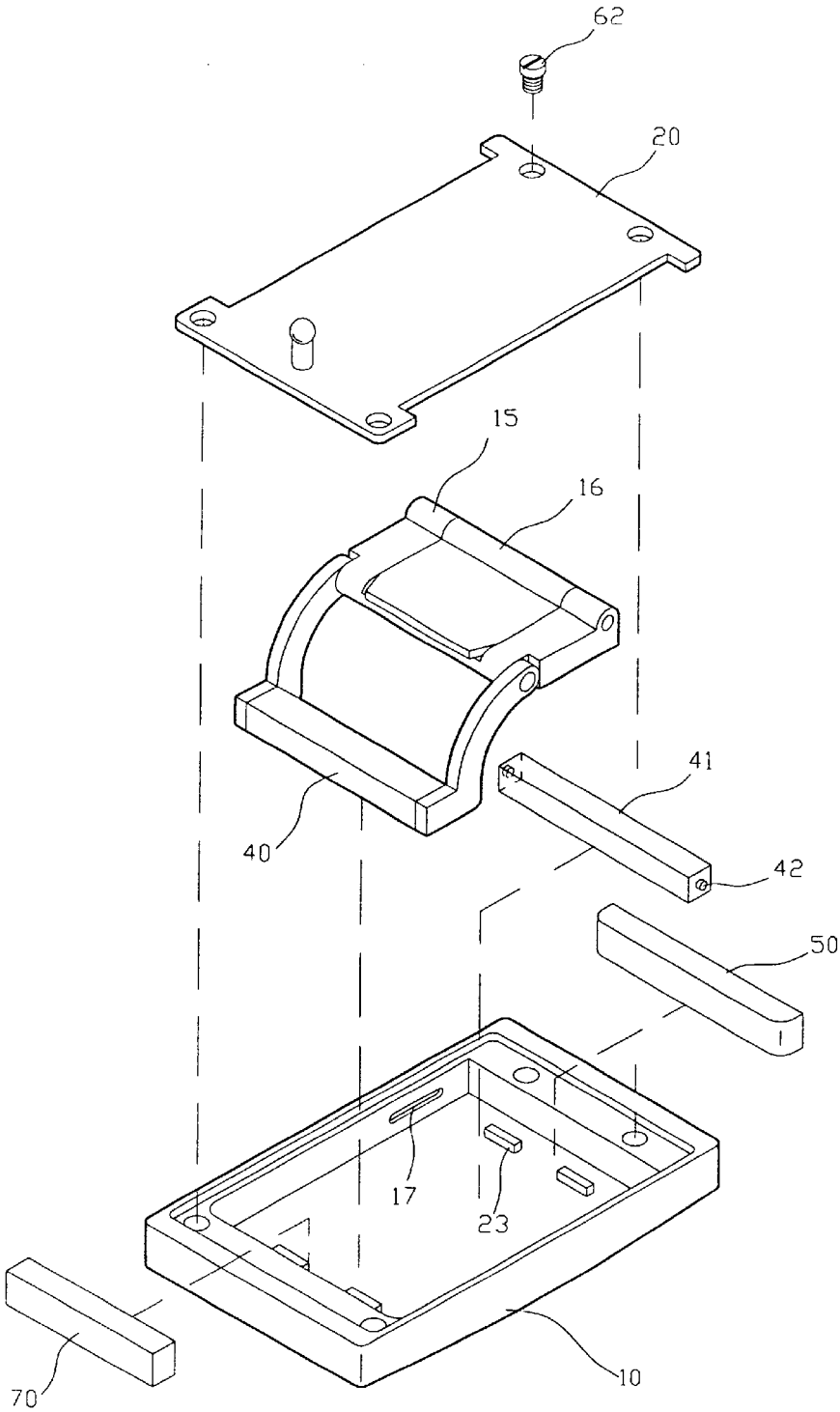
FIG. 10 is another schematic view of the internal-mounting buckle in accordance with the present invention.

FIG. 10 is another preferred embodiment of the present invention. The top cover 10 is made into a recessed structure with two lateral sliding rails 17 being formed from at the inner wall of the recessed structure for longer mounting of belt. One or more than one moving-type magnets 41 is located at the guiding slot or the sliding rails 17. The magnet 41 is mounted to a shaft rod 42, and the front and the rear end of the top housing 10 are provided with a stop 23 so that an iron block 70 can be mounted at the front end, and a magnet 50 is mounted at the rear end of the top cover 10. Another magnet 40 is provided at the front end of the fastening ring seat 15.

By means of the fastening plate 16, the end of the belt 60 can be mounted by pressing the plate 16 inward. Due to the sliding of the fastening ring seat 15 within the guiding slot 17 and the repelling force of the magnets 41, 50 having similar poles, the belt 60 can be adjusted slightly.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure of a magnetic belt buckle having a top cover, magnets, a pulling ring, an iron block, a bottom housing and at least one moving-type magnet, wherein the top cover, the bottom housing and one end of a belt are mounted with magnets of same poles to facilitate rapid adjustment of the belt by means of repelling force between the magnets so as to attain optimum fastening, and by means of the moving-type magnet mutually repelling with the other magnets, and tightening of the belt is maintained by having the moving magnet attracted to the iron block.

2. The structure of a magnetic belt buckle of claim 1, wherein a blocking element is used to resist attraction between the magnet and the iron block so as to prevent the magnet to attract to the iron block.

3. The structure of a magnetic belt buckle of claim 1, wherein a belt head mounted to a belt body is fastened externally or internally so as to hide the belt head at an inner side of the buckle.

* * * * *